US007838099B2

(12) United States Patent
Curro et al.

(10) Patent No.: US 7,838,099 B2
(45) **Date of Patent: *Nov. 23, 2010**

(54) LOOPED NONWOVEN WEB

(75) Inventors: John Joseph Curro, Cincinnati, OH (US); Eric Bryan Bond, Maineville, OH (US); John Lee Hammons, Hamilton, OH (US); Jody Lynn Hoying, Maineville, OH (US); Susan Nicole Lloyd, Erlanger, KY (US); Robert Haines Turner, Cincinnati, OH (US); Terrill Alan Young, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 313 days.

This patent is subject to a terminal disclaimer.

(21) Appl. No.: 11/155,805

(22) Filed: Jun. 17, 2005

(65) Prior Publication Data

US 2005/0281976 A1 Dec. 22, 2005

Related U.S. Application Data

(63) Continuation-in-part of application No. 10/737,306, filed on Dec. 16, 2003, now Pat. No. 7,553,532, which is a continuation-in-part of application No. 10/435,996, filed on May 12, 2003, now abandoned, which is a continuation-in-part of application No. 10/324,661, filed on Dec. 20, 2002, now abandoned, application No. 11/155,805, which is a continuation-in-part of application No. 10/737,430, filed on Dec. 16, 2003, now Pat. No. 7,410,683, which is a continuation-in-part of application No. 10/610,299, filed on Jun. 30, 2003, now abandoned.

(60) Provisional application No. 60/581,679, filed on Jun. 21, 2004.

(51) Int. Cl.
*B32B 3/10* (2006.01)
*B32B 33/00* (2006.01)
*D04H 11/00* (2006.01)

(52) U.S. Cl. ..... 428/96; 428/88; 428/92; 428/133; 428/137; 428/139

(58) Field of Classification Search ..... 428/88, 428/92, 96, 133, 137, 139
See application file for complete search history.

(56) References Cited

U.S. PATENT DOCUMENTS 2,068,456 A 1/1937 Hooper (Continued)

FOREIGN PATENT DOCUMENTS

EP 0 509 012 B1 7/1995

(Continued)

OTHER PUBLICATIONS

PCT International Search Report dated Nov. 1, 2006.

(Continued)

Primary Examiner—Jenna-Leigh Johnson
(74) *Attorney, Agent, or Firm*—Andrew J. Hagerty; Gary J. Foose; Roddy M. Bullock

(57) ABSTRACT

The present invention relates to a nonwoven web comprising a plurality of loops. At least one of said loops having a loop circumference length to loop base length ratio that is greater than about 4:1. The loops may also have a base length less than 0.5 cm and a base length less than the maximum width of the loops. The present invention also relates to articles selected from the group consisting of disposable hygiene article and wipes comprising a nonwoven web wherein at least one region of the nonwoven web comprises loops in at least about 10% of the surface area of the nonwoven web. A method for producing a nonwoven web comprising a plurality of loops is also included. The method comprises the steps of providing a nonwoven web; providing means for moving fibers of the nonwoven web into the shape of a loop; and moving fibers of the nonwoven web into the shape of a loop.

10 Claims, 10 Drawing Sheets

U.S. PATENT DOCUMENTS

| | | | |
|---|---|---|---|
| 2,275,425 | A | 3/1942 | Grabec |
| 2,404,758 | A | 7/1946 | Teague et al. |
| 2,633,441 | A | 3/1953 | Buttress |
| 2,748,863 | A | 6/1956 | Benton |
| 2,924,863 | A | 2/1960 | Chavannes |
| 3,073,304 | A | 1/1963 | Schaar |
| 3,081,500 | A | 3/1963 | Griswold et al. |
| 3,081,512 | A | 3/1963 | Griswold |
| 3,097,787 | A | 7/1963 | Schur |
| 3,137,893 | A | 6/1964 | Gelpke |
| 3,355,974 | A | 12/1967 | Carmichael |
| 3,511,740 | A | 5/1970 | Sanders |
| 3,542,634 | A | 11/1970 | Such et al. |
| 3,566,726 | A | 3/1971 | Politis |
| 3,579,763 | A | 5/1971 | Sommer |
| 3,681,182 | A | 8/1972 | Kalwaites |
| 3,681,183 | A | 8/1972 | Kalwaites |
| 3,684,284 | A | 8/1972 | Tranfield |
| 3,695,270 | A | 10/1972 | Dostal |
| 3,718,059 | A | 2/1973 | Clayton |
| 3,760,671 | A | 9/1973 | Jenkins |
| 3,881,987 | A | 5/1975 | Benz |
| 3,949,127 | A | 4/1976 | Ostermeier et al. |
| 3,965,906 | A | 6/1976 | Karami |
| 4,035,881 | A | 7/1977 | Zocher et al. |
| 4,042,453 | A | 8/1977 | Conway |
| 4,135,021 | A | 1/1979 | Patchell et al. |
| 4,276,336 | A | 6/1981 | Sabee |
| 4,379,799 | A | 4/1983 | Holmes |
| 4,397,644 | A | 8/1983 | Matthews et al. |
| 4,433,018 | A | 2/1984 | Tesch et al. |
| 4,465,726 | A | 8/1984 | Holmes |
| 4,469,734 | A | 9/1984 | Minto et al. |
| 4,588,630 | A | 5/1986 | Shimalla |
| 4,596,567 | A | 6/1986 | Iskra |
| 4,741,941 | A | 5/1988 | Englebert et al. |
| 4,758,297 | A | 7/1988 | Calligarich |
| 4,781,962 | A | 11/1988 | Zamarripa et al. |
| 4,798,604 | A | 1/1989 | Carter |
| 4,820,294 | A | 4/1989 | Morris |
| 4,840,829 | A | 6/1989 | Suzuki et al. |
| 4,859,519 | A | 8/1989 | Cabe, Jr. et al. |
| 4,886,632 | A | 12/1989 | Van Iten et al. |
| 4,935,087 | A | 6/1990 | Gilman |
| 4,953,270 | A | 9/1990 | Gilpatrick |
| 5,019,062 | A | 5/1991 | Ryan et al. |
| 5,062,418 | A | 11/1991 | Dyer |
| 5,144,730 | A | 9/1992 | Dilo |
| 5,165,979 | A | 11/1992 | Watkins et al. |
| 5,171,238 | A | 12/1992 | Kajander |
| 5,180,620 | A | 1/1993 | Mende |
| 5,188,625 | A | 2/1993 | Van Iten et al. |
| 5,223,319 | A | 6/1993 | Cotton et al. |
| 5,239,734 | A | 8/1993 | Bathelier et al. |
| 5,242,632 | A | 9/1993 | Mende |
| 5,382,245 | A | 1/1995 | Thompson |
| 5,383,870 | A | 1/1995 | Takai et al. |
| 5,387,209 | A | 2/1995 | Yamamoto et al. |
| 5,414,914 | A | 5/1995 | Suzuki et al. |
| 5,415,640 | A | 5/1995 | Kirby et al. |
| 5,429,854 | A | 7/1995 | Currie et al. |
| 5,437,653 | A | 8/1995 | Gilman et al. |
| 5,470,326 | A | 11/1995 | Dabi et al. |
| 5,508,080 | A | 4/1996 | Sorimachi et al. |
| 5,518,801 | A | 5/1996 | Chappell et al. |
| 5,533,991 | A | 7/1996 | Kirby et al. |
| 5,554,145 | A | 9/1996 | Roe |
| 5,560,794 | A | 10/1996 | Currie et al. |
| 5,567,501 | A | 10/1996 | Srinivasan et al. |
| D375,844 | S | 11/1996 | Edwards et al. |
| 5,573,719 | A | 11/1996 | Fitting |
| 5,575,874 | A | 11/1996 | Griesbach, III et al. |
| 5,580,418 | A | 12/1996 | Alikhan |
| 5,599,420 | A | 2/1997 | Yeo et al. |
| 5,624,427 | A | 4/1997 | Dreier et al. |
| 5,626,571 | A | 5/1997 | Young et al. |
| 5,628,097 | A | 5/1997 | Benson |
| 5,648,142 | A | 7/1997 | Phillips |
| 5,650,214 | A | 7/1997 | Anderson et al. |
| 5,656,119 | A | 8/1997 | Srinivasan et al. |
| 5,658,639 | A | 8/1997 | Curro et al. |
| 5,667,619 | A | 9/1997 | Alikhan |
| 5,667,625 | A | 9/1997 | Alikhan |
| 5,691,035 | A | 11/1997 | Chappell et al. |
| 5,700,255 | A | 12/1997 | Curro |
| 5,704,101 | A | 1/1998 | Majors et al. |
| 5,709,829 | A | 1/1998 | Giacometti |
| 5,714,107 | A | 2/1998 | Levy et al. |
| 5,723,087 | A | 3/1998 | Chappell et al. |
| 5,725,927 | A * | 3/1998 | Zilg et al. ..... 428/89 |
| 5,730,738 | A | 3/1998 | McFall et al. |
| 5,743,776 | A | 4/1998 | Igaue |
| 5,792,404 | A | 8/1998 | Cree et al. |
| 5,804,021 | A | 9/1998 | Abuto et al. |
| 5,814,389 | A | 9/1998 | Giacometti |
| 5,817,394 | A | 10/1998 | Alikhan et al. |
| 5,841,107 | A | 11/1998 | Riva |
| 5,858,504 | A | 1/1999 | Fitting |
| 5,876,391 | A | 3/1999 | Roe et al. |
| 5,879,494 | A | 3/1999 | Hoff et al. |
| 5,891,544 | A | 4/1999 | Chappell et al. |
| 5,895,623 | A | 4/1999 | Trokhan et al. |
| 5,914,084 | A | 6/1999 | Benson et al. |
| 5,916,661 | A | 6/1999 | Benson et al. |
| 5,919,177 | A | 7/1999 | Georger et al. |
| 5,925,026 | A | 7/1999 | Arteman et al. |
| 5,932,316 | A | 8/1999 | Cree et al. |
| 5,964,742 | A | 10/1999 | McCormack et al. |
| 5,968,029 | A | 10/1999 | Chappell |
| 5,986,167 | A | 11/1999 | Arteman et al. |
| 5,993,432 | A | 11/1999 | Lodge et al. |
| 6,007,468 | A | 12/1999 | Giacometti |
| 6,025,050 | A | 2/2000 | Srinivasan et al. |
| 6,027,483 | A | 2/2000 | Chappell et al. |
| 6,039,555 | A | 3/2000 | Tsuji et al. |
| 6,048,600 | A | 4/2000 | Hansson |
| 6,096,016 | A | 8/2000 | Tsuji et al. |
| 6,114,263 | A | 9/2000 | Benson et al. |
| 6,117,524 | A | 9/2000 | Hisanaka et al. |
| 6,120,718 | A | 9/2000 | Kotek et al. |
| 6,129,801 | A | 10/2000 | Benson et al. |
| 6,155,083 | A | 12/2000 | Goeser et al. |
| 6,168,849 | B1 | 1/2001 | Braverman et al. |
| 6,176,954 | B1 | 1/2001 | Tsuji et al. |
| 6,222,092 | B1 * | 4/2001 | Hansen et al. ..... 604/378 |
| 6,247,914 | B1 | 6/2001 | Lindquist et al. |
| D444,631 | S | 7/2001 | Woodbridge et al. |
| 6,264,872 | B1 | 7/2001 | Majors et al. |
| 6,287,407 | B1 | 9/2001 | Stein et al. |
| 6,383,431 | B1 | 5/2002 | Dobrin et al. |
| 6,395,122 | B1 | 5/2002 | Hisanaka et al. |
| 6,395,211 | B1 | 5/2002 | Dettmer et al. |
| 6,398,895 | B1 | 6/2002 | Stein et al. |
| 6,410,823 | B1 | 6/2002 | Daley et al. |
| 6,420,625 | B1 | 7/2002 | Jones et al. |
| 6,423,884 | B1 | 7/2002 | Oehmen |
| 6,451,718 | B1 | 9/2002 | Yamada et al. |
| 6,452,064 | B1 | 9/2002 | Thoren et al. |
| 6,458,447 | B1 | 10/2002 | Cabell |
| D466,702 | S | 12/2002 | Carlson et al. |
| 6,506,329 | B1 | 1/2003 | Curro et al. |
| 6,537,936 | B1 | 3/2003 | Busam et al. |
| 6,620,485 | B1 | 9/2003 | Benson et al. |
| 6,632,504 | B1 | 10/2003 | Gillespie et al. |

| | | | | |
|---|---|---|---|---|
| D481,872 | S | 11/2003 | Hennel et al. | |
| 6,647,549 | B2 | 11/2003 | McDevitt et al. | |
| 6,669,878 | B2 | 12/2003 | Yamada et al. | |
| 6,716,498 | B2 | 4/2004 | Curro et al. | |
| 6,726,870 | B1 | 4/2004 | Benson et al. | |
| 6,733,610 | B2 * | 5/2004 | Mizutani et al. | 156/164 |
| 6,736,916 | B2 | 5/2004 | Steinke et al. | |
| 6,808,791 | B2 | 10/2004 | Curro et al. | |
| 6,818,802 | B2 | 11/2004 | Takai et al. | |
| 6,830,800 | B2 | 12/2004 | Curro et al. | |
| 6,837,956 | B2 | 1/2005 | Cowell et al. | |
| 6,855,220 | B2 | 2/2005 | Wildeman | |
| 6,863,960 | B2 | 3/2005 | Curro et al. | |
| 6,872,274 | B2 | 3/2005 | Kauschke et al. | |
| 6,878,433 | B2 | 4/2005 | Curro et al. | |
| 6,884,494 | B1 | 4/2005 | Curro et al. | |
| 7,005,558 | B1 | 2/2006 | Johansson et al. | |
| 7,037,569 | B2 | 5/2006 | Curro et al. | |
| 2002/0028624 | A1 * | 3/2002 | Mizutani et al. | 442/394 |
| 2002/0029445 | A1 | 3/2002 | Laun et al. | |
| 2002/0039867 | A1 | 4/2002 | Curro et al. | |
| 2002/0082574 | A1 | 6/2002 | Nakashita | |
| 2002/0103469 | A1 | 8/2002 | Chen et al. | |
| 2002/0105110 | A1 | 8/2002 | Dobrin et al. | |
| 2002/0107495 | A1 | 8/2002 | Chen et al. | |
| 2002/0119720 | A1 | 8/2002 | Arora et al. | |
| 2002/0132544 | A1 | 9/2002 | Takagaki | |
| 2003/0021951 | A1 | 1/2003 | Desai et al. | |
| 2003/0028165 | A1 | 2/2003 | Curro et al. | |
| 2003/0085213 | A1 | 5/2003 | Burckhardt et al. | |
| 2003/0191442 | A1 | 10/2003 | Bewick-Sonntag | |
| 2003/0191443 | A1 | 10/2003 | Taylor | |
| 2004/0022993 | A1 | 2/2004 | Wildeman | |
| 2004/0157036 | A1 | 2/2004 | Wildeman | |
| 2004/0121686 | A1 | 6/2004 | Wong et al. | |
| 2004/0122396 | A1 | 6/2004 | Maldonado et al. | |
| 2004/0126531 | A1 | 7/2004 | Harvey et al. | |
| 2004/0131820 | A1 | 7/2004 | Turner et al. | |
| 2004/0137200 | A1 | 7/2004 | Chhabra et al. | |
| 2004/0161991 | A1 | 8/2004 | Walton et al. | |
| 2004/0229008 | A1 | 11/2004 | Hoying et al. | |
| 2004/0242097 | A1 | 12/2004 | Hasenoehrl et al. | |
| 2004/0265533 | A1 | 12/2004 | Hoying et al. | |
| 2004/0265534 | A1 | 12/2004 | Curro et al. | |
| 2005/0064136 | A1 | 3/2005 | O'Donnell et al. | |
| 2005/0096614 | A1 | 5/2005 | Perez et al. | |
| 2005/0123726 | A1 | 6/2005 | Broering | |
| 2005/0281976 | A1 | 12/2005 | Curro et al. | |
| 2005/0283129 | A1 | 12/2005 | Hammons et al. | |
| 2006/0019056 | A1 | 1/2006 | Turner et al. | |
| 2006/0087053 | A1 | 4/2006 | O'Donnell et al. | |
| 2006/0286343 | A1 | 12/2006 | Curro et al. | |

FOREIGN PATENT DOCUMENTS

| | | | |
|---|---|---|---|
| EP | 688 200 | B1 | 4/1999 |
| EP | 0 955 159 | A1 | 11/1999 |
| EP | 0 963 747 | A1 | 12/1999 |
| EP | 1 004 412 | A1 | 5/2000 |
| EP | 1 350 456 | A1 | 10/2003 |
| FR | 2 713 083 | A1 | 3/1993 |
| FR | 2 713 083 | A1 | 6/1995 |
| WO | WO 01/76523 | A2 | 10/2001 |
| WO | WO 02/100632 | A1 | 12/2002 |
| WO | WO 2005/011936 | A1 | 2/2005 |

OTHER PUBLICATIONS

Office Action for U.S. Appl. No. 11/129,877 dated Mar. 30, 2007; P&G Case 9684M; Cabell; filing date May 16, 2005.

Office Action for U.S. Appl. No. 11/129,877 dated Oct. 2, 2007; P&G Case 9684M; Cabell; filing date May 16, 2005.

Office Action for U.S. Appl. No. 11/129,877 dated Jan. 23, 2008; P&G Case 9684M; Cabell; filing date May 16, 2005.

Office Action for U.S. Appl. No. 11/129,877 dated Jun. 12, 2008; P&G Case 9684M; Cabell; filing date May 16, 2005.

Office Action for U.S. Appl. No. 12/370,850 dated Jul. 8, 2009; P&G Case 9683MC; Turner et al.; filing date Feb. 13, 2009.

Office Action for U.S. Appl. No. 11/158,165 dated May 16, 2008; P&G Case 9683M; Turner et al.; filing date Jun. 21, 2005.

Office Action for U.S. Appl. No. 11/158,165 dated Dec. 7, 2007; P&G Case 9683M; Turner et al.; filing date Jun. 21, 2005.

Office Action for U.S. Appl. No. 11/158,165 dated Jul. 3, 2007; P&G Case 9683M; Turner et al; filing date Jun. 21, 2005.

Office Action for U.S. Appl. No. 11/157,770 dated Apr. 28, 2009; P&G Case 9682M; Hammons et al.; filing date Jun. 21, 2005.

Office Action for U.S. Appl. No. 11/157,770 dated Jun. 2, 2008; P&G Case 9682M; Hammons et al.; filing date Jun. 21, 2005.

Office Action for U.S. Appl. No. 11/157,770 dated Oct. 1, 2007; P&G Case 9682M; Hammons et al.; filing date Jun. 21, 2005.

Office Action for U.S. Appl. No. 11/156,020 dated Jul. 8, 2009; P&G Case 9681M; Curro et al.; filing date Jun. 17, 2005.

Office Action for U.S. Appl. No. 11/156,020 dated Dec. 24, 2008; P&G Case 9681M; Curro et al.; filing date Jun. 17, 2005.

Office Action for U.S. Appl. No. 11/156,020 dated Jul. 10, 2008; P&G Case 9681M; Curro et al.; filing date Jun. 21, 2005.

Office Action for U.S. Appl. No. 11/156,020 dated Nov. 27, 2007; P&G Case 9681M; Curro et al.; filing date Jun. 17, 2005.

Office Action for U.S. Appl. No. 11/156,020 dated Jun. 20, 2007; P&G Case 9681M; Curro et al.; filing date Jun. 17, 2005.

Office Action for U.S. Appl. No. 11/156,020 dated Jan. 2, 2007; P&G Case 9681M; Curro et al.; filing date Jun. 17, 2005.

Office Action for U.S. Appl. No. 10/737,235 dated May 6, 2009; P&G Case 9456; Hoying et al.; filing date Dec. 16, 2003.

Office Action for U.S. Appl. No. 10/737,235 dated Nov. 25, 2008; P&G Case 9456; Hoying et al.; filing date Dec. 16, 2003.

Office Action for U.S. Appl. No. 10/737,235 dated Jun. 12, 2008; P&G Case 9456; Hoying et al.; filing date Dec. 16, 2003.

Office Action for U.S. Appl. No. 10/737,235 dated Dec. 12, 2007; P&G Case 9456; Hoying et al.; filing date Dec. 16, 2003.

Office Action for U.S. Appl. No. 10/737,235 dated Jul. 26, 2007; P&G Case 9456; Hoying et al.; filing date Dec. 16, 2003.

Office Action for U.S. Appl. No. 10/737,235 dated Feb. 6, 2007; P&G Case 9456; Hoying et al.; filing date Dec. 16, 2003.

Office Action for U.S. Appl. No. 10/737,235 dated Aug. 8, 2006; P&G Case 9456; Hoying et al.; filing date Dec. 16, 2003.

Office Action for U.S. Appl. No. 10/737,235 dated Feb. 3, 2006; P&G Case 9456; Hoying et al.; filing date Dec. 16, 2003.

Office Action for U.S. Appl. No. 10/737,235 dated Aug. 24, 2005; P&G Case 9456; Hoying et al.; filing date Dec. 16, 2003.

Office Action for U.S. Appl. No. 11/650,821 dated Mar. 16, 2009; P&G Case 9455C; Hoying et al.; filing date Jan. 8, 2007.

Office Action for U.S. Appl. No. 11/650,821 dated Oct. 8, 2008; P&G Case 9455C; Hoying et al.; filing date Jan. 8, 2007.

Office Action for U.S. Appl. No. 11/650,821 dated Apr. 23, 2008; P&G Case 9455C; Hoying et al.; filing date Jan. 8, 2007.

Office Action for U.S. Appl. No. 11/650,821 dated Oct. 16, 2007; P&G Case 9455C; Hoying et al.; filing date Jan. 8, 2007.

Notice of Allowance for U.S. Appl. No. 10/737,307 dated Sep. 28, 2006; P&G Case 9455; Hoying et al.; filing date Dec. 16, 2003.

Office Action for U.S. Appl. No. 10/737,307 dated May 31, 2006; P&G Case 9455; Hoying et al.; filing date Dec. 16, 2003.

Office Action for U.S. Appl. No. 10/737,307 dated Oct. 7, 2005; P&G Case 9455; Hoying et al.; filing date Dec. 16, 2003.

Notice of Allowance for U.S. Appl. No. 10/980,219 dated May 23, 2007; P&G Case 9313RR; Broering et al.; filing date Nov. 3, 2004.

Office Action for U.S. Appl. No. 10/980,219 dated Mar. 5, 2007; P&G Case 9313RR; Broering et al.; filing date Nov. 3, 2004.

Office Action for U.S. Appl. No. 10/980,219 dated Sep. 11, 2006; P&G Case 9313RR; Broering et al.; filing date Nov. 3, 2004.

Notice of Allowance for U.S. Appl. No. 10/737,430 dated Mar. 18, 2008; P&G Case 9313R; Curro et al.; filing date Dec. 16, 2003.

Notice of Allowance for U.S. Appl. No. 10/737,430 dated Oct. 29, 2007; P&G Case 9313R; Curro et al.; filing date Dec. 16, 2003.

Office Action for U.S. Appl. No. 10/737,430 dated Jul. 16, 2007; P&G Case 9313R; Curro et al.; filing date Dec. 16, 2003.

Office Action for U.S. Appl. No. 10/737,430 dated Jan. 25, 2007; P&G Case 9313R; Curro et al.; filing date Dec. 16, 2003.

Office Action for U.S. Appl. No. 10/737,430 dated Aug. 8, 2006; P&G Case 9313R; Curro et al.; filing date Dec. 16, 2003.

Office Action for U.S. Appl. No. 10/737,430 dated Feb. 3, 2006; P&G Case 9313R; Curro et al.; filing date Dec. 16, 2003.

Office Action for U.S. Appl. No. 10/737,430 dated Aug. 24, 2005; P&G Case 9313R; Curro et al.; filing date Dec. 16, 2003.

Office Action for U.S. Appl. No. 12/021,369 dated Jun. 25, 2009; P&G Case 9313RC; Curro et al.; filing date Jan. 29, 2008.

Office Action for U.S. Appl. No. 10/737,306 dated Jun. 12, 2008; P&G Case 9134R2; Gray et al.; filing date Mar. 28, 2003.

Notice of Allowance for U.S. Appl. No. 10/737,306 dated Nov. 29, 2007; P&G Case 9134R2; Gray et al.; filing date Mar. 28, 2003.

Office Action for U.S. Appl. No. 10/737,306 dated Jul. 16, 2007; P&G Case 9134R2; Gray et al.; filing date Mar. 28, 2003.

Office Action for U.S. Appl. No. 10/737,306 dated Jan. 26, 2007; P&G Case 9134R2; Gray et al.; filing date Mar. 28, 2003.

Office Action for U.S. Appl. No. 10/737,306 dated Aug. 9, 2006; P&G Case 9134R2; Gray et al.; filing date Mar. 28, 2003.

Office Action for U.S. Appl. No. 10/737,306 dated Aug. 24, 2005; P&G Case 9134R2; Gray et al.; filing date Mar. 28, 2003.

Office Action for U.S. Appl. No. 10/737,306 dated Feb. 3, 2006; P&G Case 9134R2; Gray et al.; filing date Mar. 28, 2003.

Office Action for U.S. Appl. No. 11/157,770 dated Nov. 10, 2009; P&G Case 9682M; Hammons et al.; filing date Jun. 21, 2005.

* cited by examiner

LOOPED NONWOVEN WEB

CROSS REFERENCE TO RELATED APPLICATION

This application is a continuation-in-part of U.S. application Ser. No. 10/737,306, filed Dec. 16, 2003, now U.S. Pat. No. 7,553,532, which is a continuation-in-part of U.S. application Ser. No. 10/435,996, filed May 12, 2003, now abandoned, which is a continuation-in-part of U.S. application Ser. No. 10/324,661, filed Dec. 20, 2002, now abandoned. This application is a continuation-in-part of U.S. application Ser. No. 10/737,430, filed Dec. 16, 2003, now U.S. Pat. No. 7,410,683, which is a continuation-in-part of U.S. application Ser. No. 10/610,299, filed Jun. 30, 2003, now abandoned. This application claims the benefit of U.S. Provisional Application No. 60/581,679, filed Jun. 21, 2004.

FIELD OF THE INVENTION

The field of the invention is related to nonwoven webs and products made from the nonwoven webs. More specifically, the invention is related to obtaining a textured nonwoven web that contains loops. The looped web may be used in various product applications.

BACKGROUND OF THE INVENTION

In many product applications it is desirable that fibrous webs have a bulky texture and/or softness. For example, textile wovens known as terry cloth have a bulky texture and softness and are often used for bath towels, wiping cloths, bibs, clothing, and upholstery fabric. Terry cloth is woven on specially made weaving machines, such as rapier weaving machines. Terry cloth is characterized by tufted loops of thread, and the tufts can be varied in number and density of loops. However, terry cloth is relatively expensive due to the relatively complex and expensive weaving machines necessary for its manufacture. The expense of terry cloth makes it commercially unfeasible for many applications, particularly for articles intended for limited use, such as disposable absorbent articles.

Attempts have been made to produce a nonwoven fabric having the appearance of terry cloth. For example, U.S. Pat. No. 4,465,726 and U.S. Pat. No. 4,379,799, both to Holmes et al., describe an apertured, ribbed terry cloth-like nonwoven fabric produced by fluid entangling of fibers on a special forming belt. Even if apertures could be avoided in the method disclosed in Holmes et al., it is well known that fluid entangling is a relatively expensive process for manufacture of nonwoven webs, particularly for webs intended for disposable article use. Furthermore, webs formed by fluid entangling typically have been subjected to forces of the fluid in all the regions of the web so that the entire web is subjected to the applied mechanical energy of the fluid forces.

Other methods are known to provide bulky texture and/or softness. One method includes U.S. Pat. Nos. 5,518,801 and 5,650,214 and US publication 2002-0128617-A1 which describe methods of providing elastic-like behavior and soft, cloth-like texture. Other methods include the PGI Apex technology described in U.S. Pat. Nos. 5,670,234 and 4,674,591, among others.

Despite attempts made, there is a further desire to produce nonwoven webs with terry cloth-like properties.

SUMMARY OF THE INVENTION

The present invention relates to a nonwoven web comprising at least one region containing a plurality of loops. At least a portion of said loops having a loop circumference length to loop base length ratio that is greater than about 4:1. The loops may also have a base length less than 0.5 cm and a base length less than the maximum width of the loops. The present invention also relates to articles selected from the group consisting of disposable hygiene articles and wipes comprising a nonwoven web wherein at least one region of the nonwoven web comprises loops in at least about 10% of the surface area of the nonwoven web. A method for producing a nonwoven web comprising a plurality of loops is also included. The method comprises the steps of providing a nonwoven web; providing means for moving fibers of the nonwoven web into the shape of a loop; and moving fibers of the nonwoven web into the shape of a loop.

DETAILED DESCRIPTION OF THE INVENTION

It is desired to make a nonwoven web that looks like terry cloth and have terry cloth-like properties of softness and bulk texture. Terry cloth is a woven material commonly used to make soft, absorbent products such as towels. Because of the cost of woven terry cloth products, they are not practical to use in many applications, particularly, in disposable applications. Therefore it is desired to make a nonwoven web that looks like terry cloth from a distance. To have this appearance, it is desired that the nonwoven web contain loops.

A nonwoven web is a generally planar, two dimensional web having two surfaces. The web can be a single layer or can comprise more than one layer. The web can contain more than one layer, such as a spunbond-melt blown-spunbond web (SMS), where the layers are bonded together. The web may be a laminate or composite of different materials. For example, a paper layer could be combined with a meltblown layer. The SMS web may also contain different materials.

The nonwoven webs can be produced from a variety of forming processes such as meltblowing, spunbonding, hydroentangling, spunlacing, airlaying, carding, and other suitable processes. The basis weight of the nonwoven web is generally from about 1 gsm to over 1000 gsm and for most applications less than about 300 gsm depending upon use of the web. The basis weight is considered the weight of all layers per unit area in the nonwoven web.

The nonwoven web is comprised of a plurality of fibers. The web is comprised of generally randomly oriented fibers with respect to the machine direction (MD) and cross-machine direction (CD). The fibers may be short or long and continuous or staple fibers. The fibers can have any suitable diameter and deniers. The webs may comprise a mixture of fiber sizes such as nanofibers and spunbond fibers. Nanofibers, or microfibers, are considered a fiber having a diameter of less than 1 micron. The fibers may be single or multi component and may be single or multi constituent. The fibers may be round or nonround fibers such as shaped or capillary channel fibers or mixtures thereof. The fibers may be splittable or split fibers. The diameter of the major cross-sectional dimension (diameter for a round fiber) ranges from about 0.01 microns to about 500 microns. Although the fibers may be bicomponent or shaped, it is not desired that the fibers be a yarn or a multifilament bundled structure.

Figure 1:
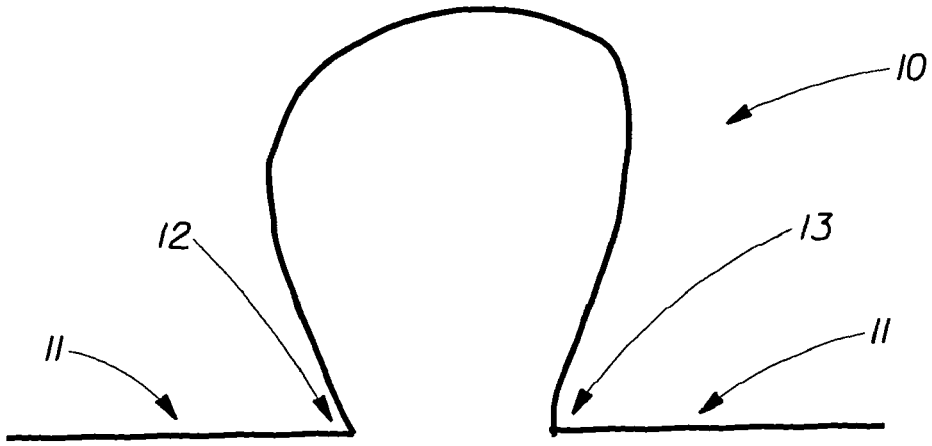
FIG. 1 is a cross-sectional view of a loop.
Figure 2:
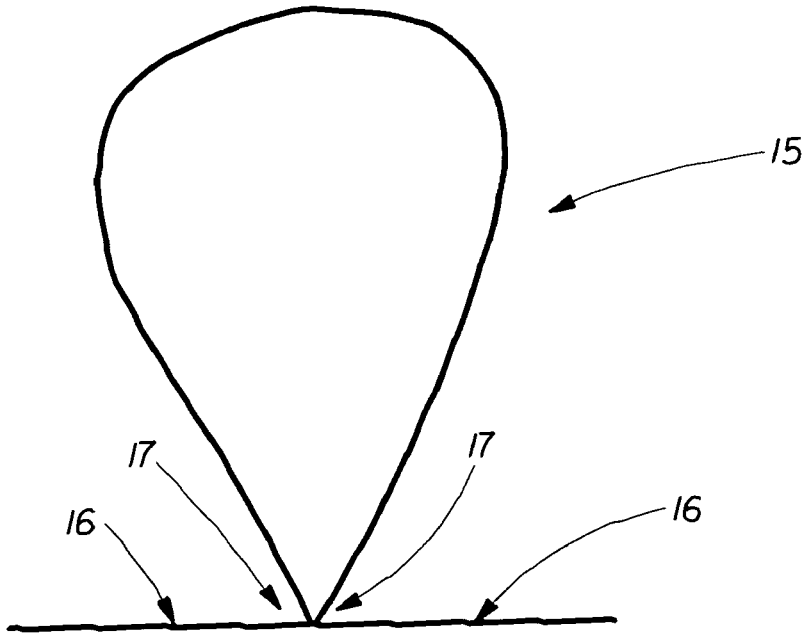
FIG. 2 is a cross-sectional view of a closed loop.

A loop is made from one or more fibers. The loop may be a bundle of fibers. In general, the fibers in a loop will generally be aligned to form the loop shape. An example of the shape of the loops is shown in FIGS. 1 and 2. In FIG. 1, the loop 10 is shown to extend from or contact the nonwoven web 11 at two origination points 12 and 13 where the loop extends out from the plane of the nonwoven web 11. The loop 10 is above and extends out from the planar surface of the web 11. The shape of the loops is in general a modified oval shape. A horseshoe shape is shown in FIG. 1 and a tear drop shape, which is a closed loop, is shown in FIG. 2. In the closed loop 15, the loop 15 will still extend from the nonwoven web 16 but it may appear to be at a single origination point 17.

Figure 3:
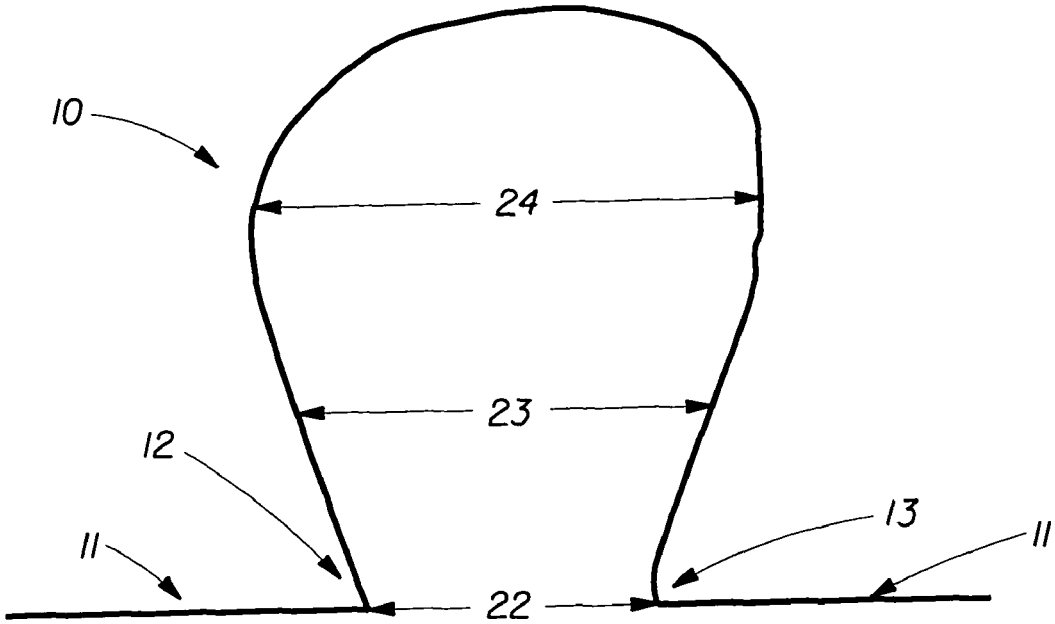
FIG. 3 is a cross-sectional view of a loop showing various measurements.
Figure 4:
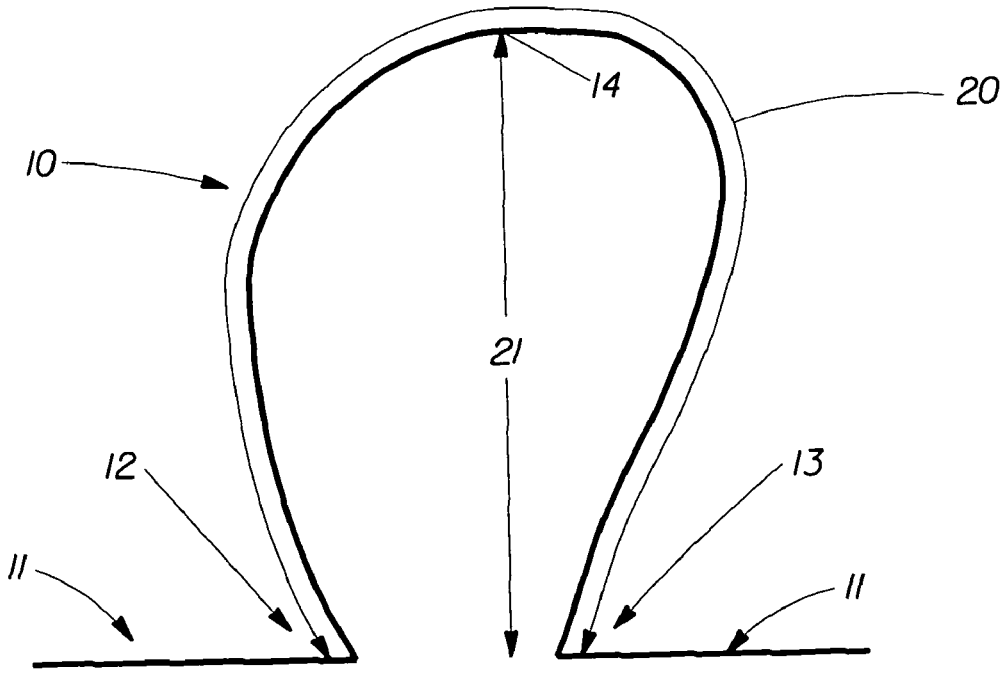
FIG. 4 is a cross-sectional view of a loop showing various measurements.

A loop will have a loop circumference length, a loop height, loop width, and loop base length. The loop circumference length 20 is shown in FIG. 4 and measured from where the loop 10 extends from the plane of the web 11, origination point 12, to where the loop 10 enters back into the plane of the web 11, origination point 13. The loop circumference 20 is defined as the pathway or perimeter of the loop. The loop circumference may be oval in shape or it may be an irregular shape. The loop height 21 is shown in FIG. 4 and is the longest straight line measurement from where the loop 10 meets or extends from the plane of the web 11 to the tip 14 of the loop 10. The loop height 21 may be measured perpendicular to the plane of the web 11. The loop width 23 and 24 is shown in FIG. 3 and is measured as a straight line across the width of the loop 10. The maximum loop width 24 is measured where the loop 10 is at its widest. The loop base length 22 is shown in FIG. 3. The loop base length 22 is measured along the plane of the web 11 from where the loop extends from the plane of the web 11 at one origination point 12 to where the loop 10 enters back into the plane of the web 11 at a second origination point 13.

The loop base length 22 will vary depending upon the size and shape of the loop. Generally, the loop base length will be less than 0.5 cm, preferably less than 0.3 cm, more preferably less than 0.2 cm, and often less than 0.1 cm. As discussed and illustrated in FIG. 2 for a closed loop, the loop base length may be zero as the fibers that extend from the web 16 at origination point 17 are touching creating a closed loop 15.

Figure 9:
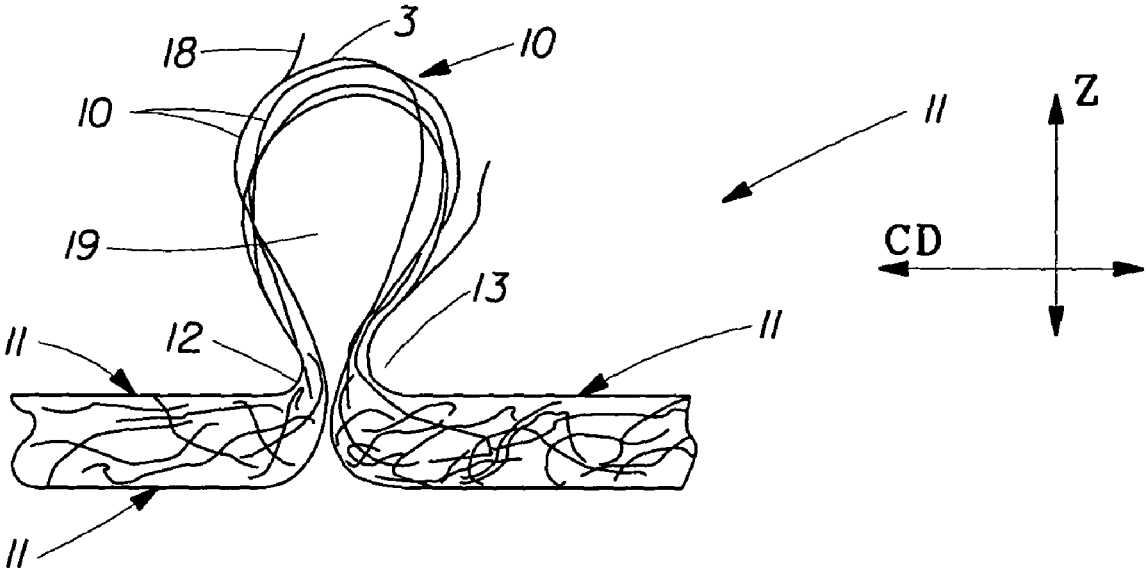
FIG. 9 is a cross-sectional view of section 3-3 of FIG. 8.

The nonwoven web will also have a thickness or height associated with it prior to texturing. This nonwoven web height 31 is shown in FIG. 9 and is measured in a looped web in an area distanced from the loop base. The measurement is made perpendicular to the planar surface of the nonwoven web. Loops will have a loop height 21 to nonwoven web height 31 ratio of greater than 1:1. Preferably this ratio is greater than about 2:1 and more preferably greater than about 4:1.

Figure 6:
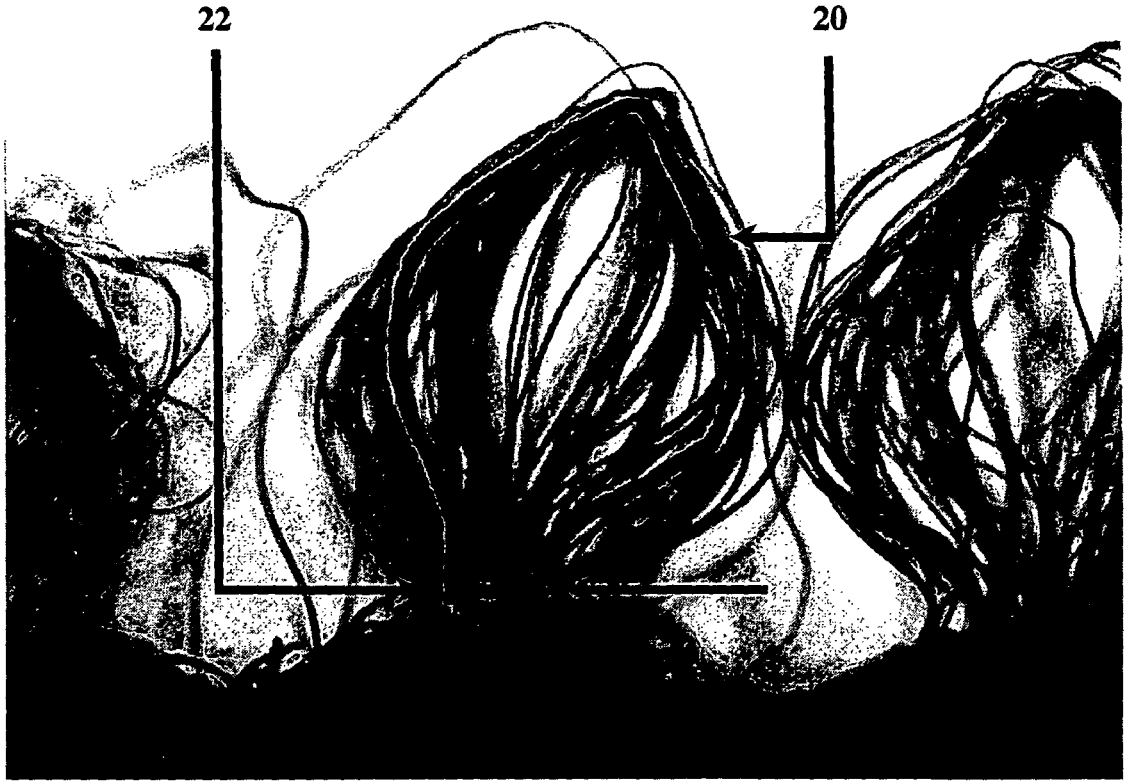
FIG. 6 is a photomicrograph of a loop.

The loops will have a loop circumference length to loop base length ratio of greater than 4:1. Preferably, this ratio is greater than about 5:1, more preferably greater than about 8:1, and most preferably greater than about 10:1. This means that the loop has a relatively narrow base and wider upper portion of the loop. The ratio of loop circumference length to loop base length may be infinity in cases where the loop base length is zero or not measurable as the fibers that extend out from the web to form the loop are touching. This can be described as a closed loop. Typically, other textured nonwoven webs not having loops will have wide "tent", "bump" "bubble", or semicircle like shapes. These shapes will typically have a loop circumference length to loop base length ratio of around 2:1 or 3:1, which is not desired by the present invention The characteristics of a looped fibrous web can be measured with any suitable optical magnification system or scanning electron microscope (SEM) that has the capability of capturing images for measuring features in the 50-100× magnification range. One suitable microscope is a digital microscope with built-in image analysis such as model VHX-100 from Keyence Corporation of America in Woodcliff Lake, N.J. By magnifying and viewing the looped fibrous web in a direction collinear with the longitudinal axis, an image of the loop can be obtained for measurement. As shown in FIG. 6, the loop circumference length 20 and the loop base length 22 can be obtained using a scale calibrated to the image magnification. In cases, where there is a tuft or group of fibers that are in some alignment, the loop circumference length 20 is measured as a median or mid-point of the fibers within a tuft or group of aligned fibers. Because the loops can be comprises of a plurality of fibers, the average loop circumference length, average loop height, average loop width, and average loop base length may be calculated.

To measure the loop, arrange the looped fibrous web so that the viewing direction is collinear with the longitudinal axis of the loops. Adjust the magnification so that one loop is completely in view. If necessary, a cross-section of the loops can be obtained by cutting the loop perpendicular to the longitudinal axis using sharp scissors or a razor blade, taking care in preserving the overall geometry of the loop while cutting it. Measure and record the loop circumference length 20 by starting the measurement at the first origination point 12, proceeding along the median path of the looped fibers 10, and terminating the measurement at the second origination point 13. Measure and record the loop base length 22, parallel to the plane of the web 11 between the first origination point 12 and second origination point 13. The loop base length is near where the loop protrudes from the plane and at the narrowest point on the loop. The loop base length is measured parallel to the plane of the web and may be at the plane of the web or above the plane of the web. The loops are measured where the loops are not under any pressure or strain. The loops may be "combed" or pushed into a standing position to accurately take loop measurements. Although the combing or holding of the loops to take measurement will change the shape of the loop and may change the loop height and width measurement, it will not change the loop base length and loop circumference length. The loop height or circumference length may also be measured by cutting the loops (i.e. through the use of a sweater shaver) at the base and then measuring the length.

The loops will have a narrow base. It is preferred that the maximum loop width be greater than the loop base length. Preferably the maximum loop width to base length ratio is greater than about 1.2:1, more preferably greater than about 1.5:1, and even more preferably greater than about 2:1 and 3:1. If the loop has a very narrow base or it is a closed loop, this ratio may be greater than 5:1 to 10:1 or infinity as the loop base length approaches zero. The loop height to base length ratio is generally greater than about 2:1 depending upon the shape of the loop. Often times the loop height to base length ratio is greater than about 3:1 and preferably greater than about 5:1. The ratio may be greater than 10:1 or infinity as the loop base length approaches zero. A tall loop that extends well from the web and holds this shape will generally have a narrower width and therefore a smaller width to base ratio and a larger height to base ratio. Shorter, squatty loops which fall over or do not extend far from the web will have a larger maximum loop width ratio and smaller height ratio.

Figure 5:
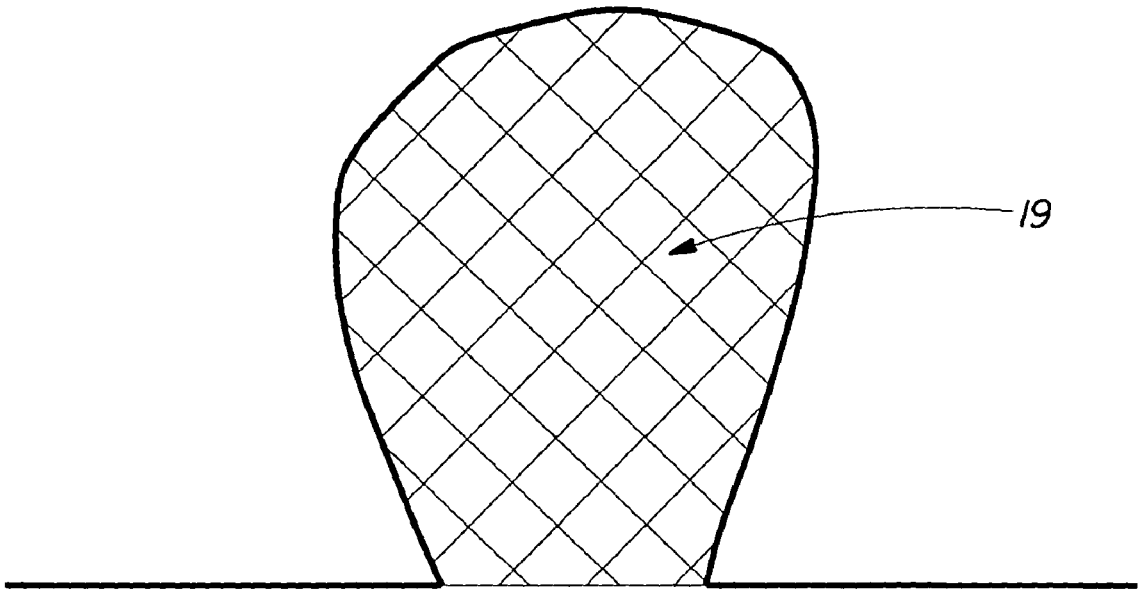
FIG. 5 is a cross-sectional view of a loop showing the void area.

The void area in a loop can also be measured. The void area is defined as the area contained inside the loop. FIG. 5 shows the void area 19 as the cross-hatch region.

The loops will extend out of the plane of the web. The loops will generally only contact the web where the base of the loop is located. The base of the loop is defined as the bottom of the loop where it contacts the web. A loop may 'fall over' and touch the web at another point on the loop. The degree of the 'standing up' of the loops depending upon the material used to make the loop, the height of the loop, the loop circumference length, and the maximum loop width, any stress or strain applied to the loops, how many loops are present in a tuft, and other factors.

The loops are oriented so that they extend outwardly from the plane of the web. For example, if a web is lying generally flat on a table, the loops will extend upward or toward the ceiling. When the web is utilized on a hygiene product, the loops can be on the external side of the product. The loops may be on the body facing or non-body facing side of the product.

The web density is calculated using the basis weight divided by caliper wherein the caliper is measured at 0.004 psi. The web density is typically less than about 0.05 grams/cm3. The density of a web that is looped will be less than the density of a web made of the same material and basis weight. Generally, the looped web density is about 20% less, preferably about 25% less, more preferably about 30% less, and even more preferably about 35% less than the same web that does not contain loops.

The number of loops in a measured area can be counted through the use of a SEM. Generally, there are at least about 10 loops per square centimeter of web. Preferably, there are at least about 100 loops, more preferably more than 200 loops, and most preferably more than 400 loops per square centimeter of web. Each fiber is counted as a loop so the number of loops per square centimeter of web may be greater than 1000 loops.

Another measurement to determine the amount of loops on a web is the percent of surface area of the web that contains loops. When web is in a generally flat or planar position, the surface area of the web can be measured. For a web to be described as a looped web, at least one region the web will have at least about 10% of its surface area containing loops. Alternatively, 10% of the loops in the region of the web containing loops will have loops that have a loop circumference length to loop base length ratio that is greater than about 4:1. The areas of the web that do not contain loops may be textured in a way that does not result in loops. The web may contain different or multiple regions. The different regions may be areas of the web that are desired to have different texture or different uses. The region of the web containing loops has at least about 10% of its surface area containing loops. Preferably, the web will have at least about 25%, more preferably at least about 50%, and most preferably at least about 75% of its surface area containing loops. In many cases, 100% of the surface area of a region of a web will contain loops when a planar or top down view is used.

Depending upon the process used to make the loops, the desired use of the web, the materials used, and other characteristics, some of the loops may be cut loops. This may be done intentionally to form cut loops. Other loose fiber strands, which may appear as cut fibers, may form without intentionally creating the cut loops.

The loops of the nonwoven web may be of similar shape and size or may have different sizes and shapes. For example, some loops may have a larger height and be considered tall loops. These loops 'stand up' well. Other loops may be shorter, wider loops.

A tuft will comprise more than one loop. A group of loops may or may not be aligned to form the tuft. If the loops are not aligned, there will be loops in a variety of orientations. If the loops are generally aligned, the tuft will appear as a tunnel shape. There may be bonding that occurs between the fibers forming the loop. This may be from the starting nonwoven web being prebonded, bonding of fibers that occurs during formation of the loop, or from post processing steps that promote the bonding of fibers within the loop.

The nonwoven web will have loops extending from the plane or surface of the web. The plane is described as when the web is generally flat. The loops will extend generally perpendicular from the web. Depending upon the number of loops and how close the loops are together, one loop may hold up another loop or the loops may be touching. The loops may extend out of the web on an angle. The number of loops in a measured area can be counted.

The nonwoven webs may have basis weights in a variety of ranges depending upon the use of the web. For use as a towel or wash cloth, the web may have a basis weight of greater than 200 gsm. For use as a wipe, the basis weight is generally from about 20 gsm to about 100 gsm and preferably from about 40 gsm to about 80 gsm. For use as a component of a hygiene article, the basis weight may range from 6 gsm to about 90 gsm. Typical basis weight ranges for composite webs are from about 5 gsm to about 300 gsm, preferably from about 10 gsm to about 200 gsm, more preferably from about 13 gsm to about 120 gsm, and even more preferably from about 20 gsm to about 100 gsm.

Figure 7:
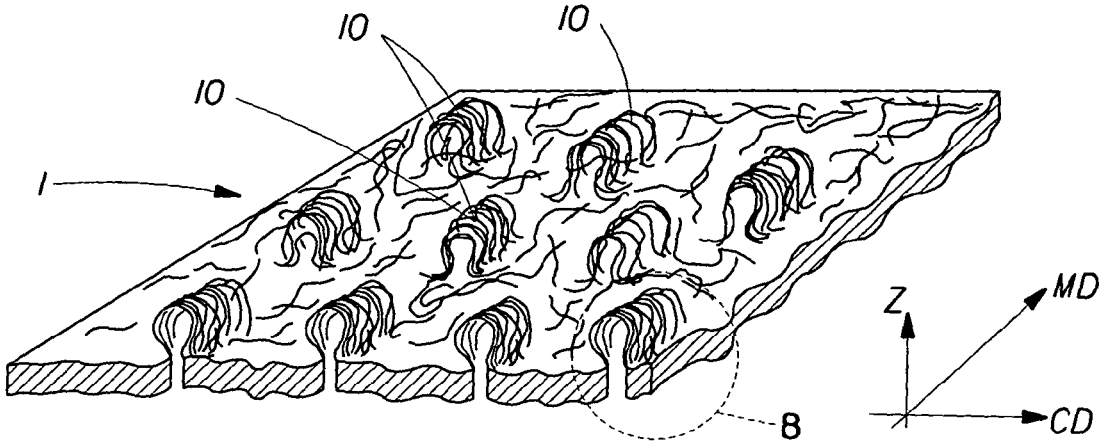
FIG. 7 is a perspective view of a looped web.
Figure 8:
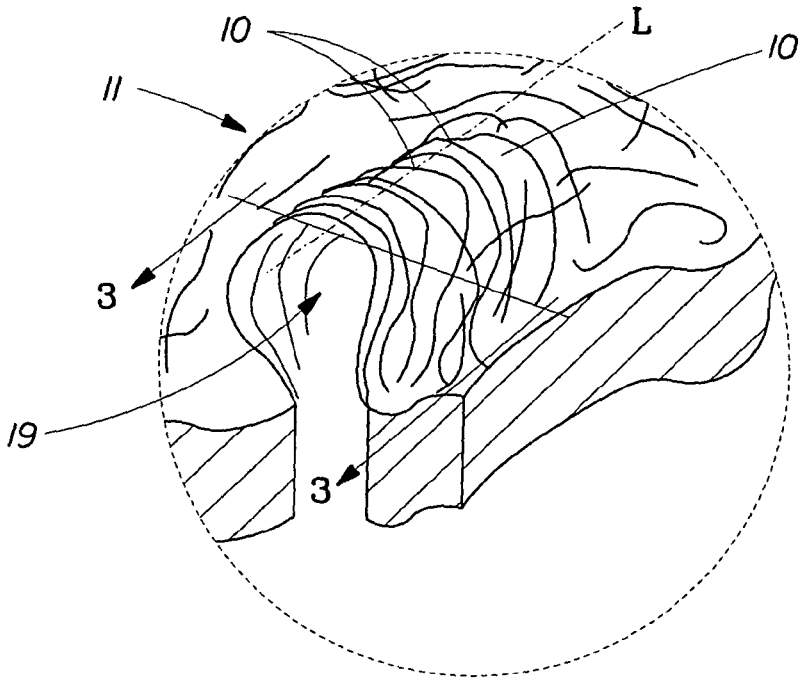
FIG. 8 is an enlarged view of a portion of the looped web.
Figure 10:
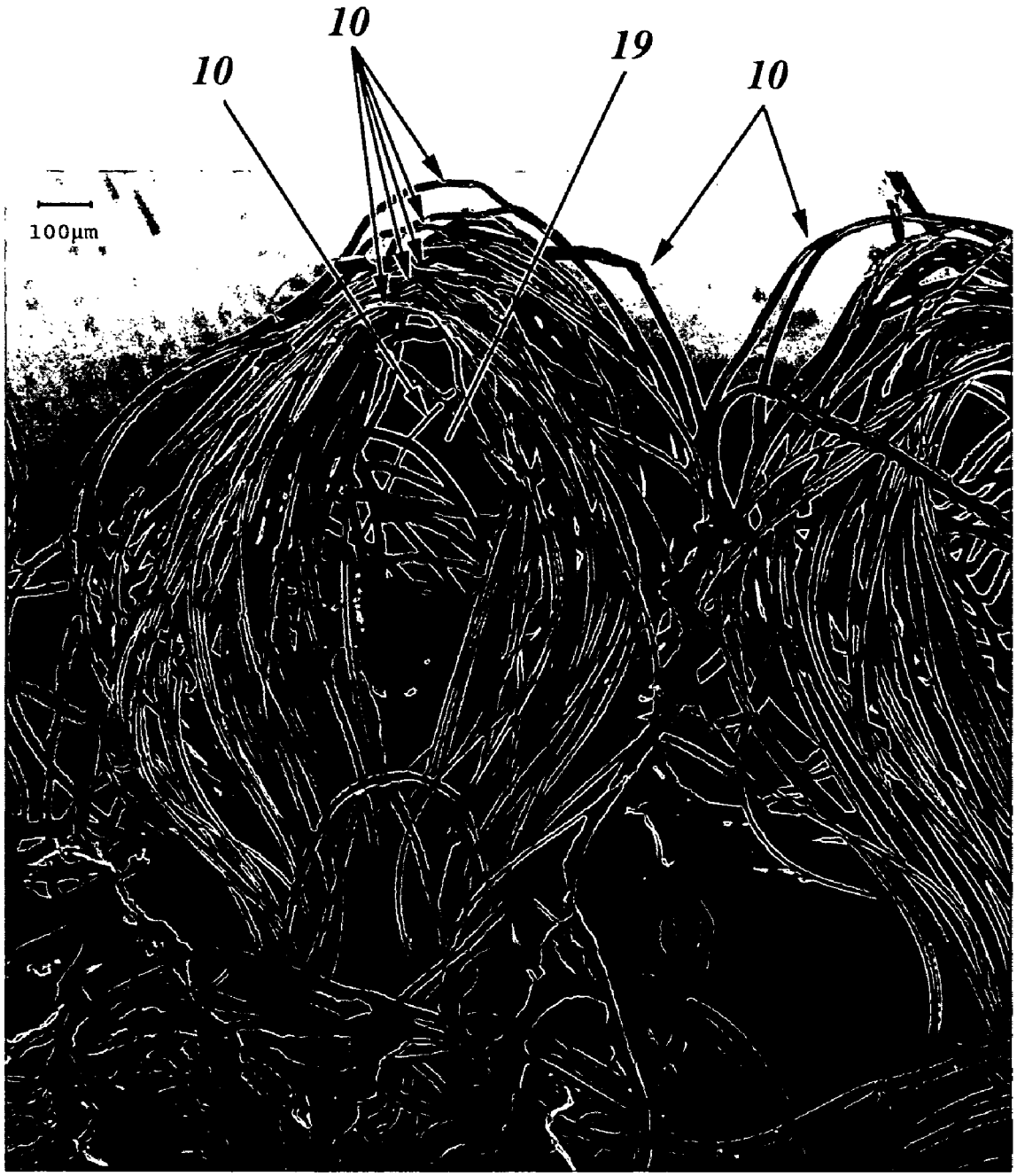
FIG. 10 is a photomicrograph of a portion of the looped web.
Figure 11:
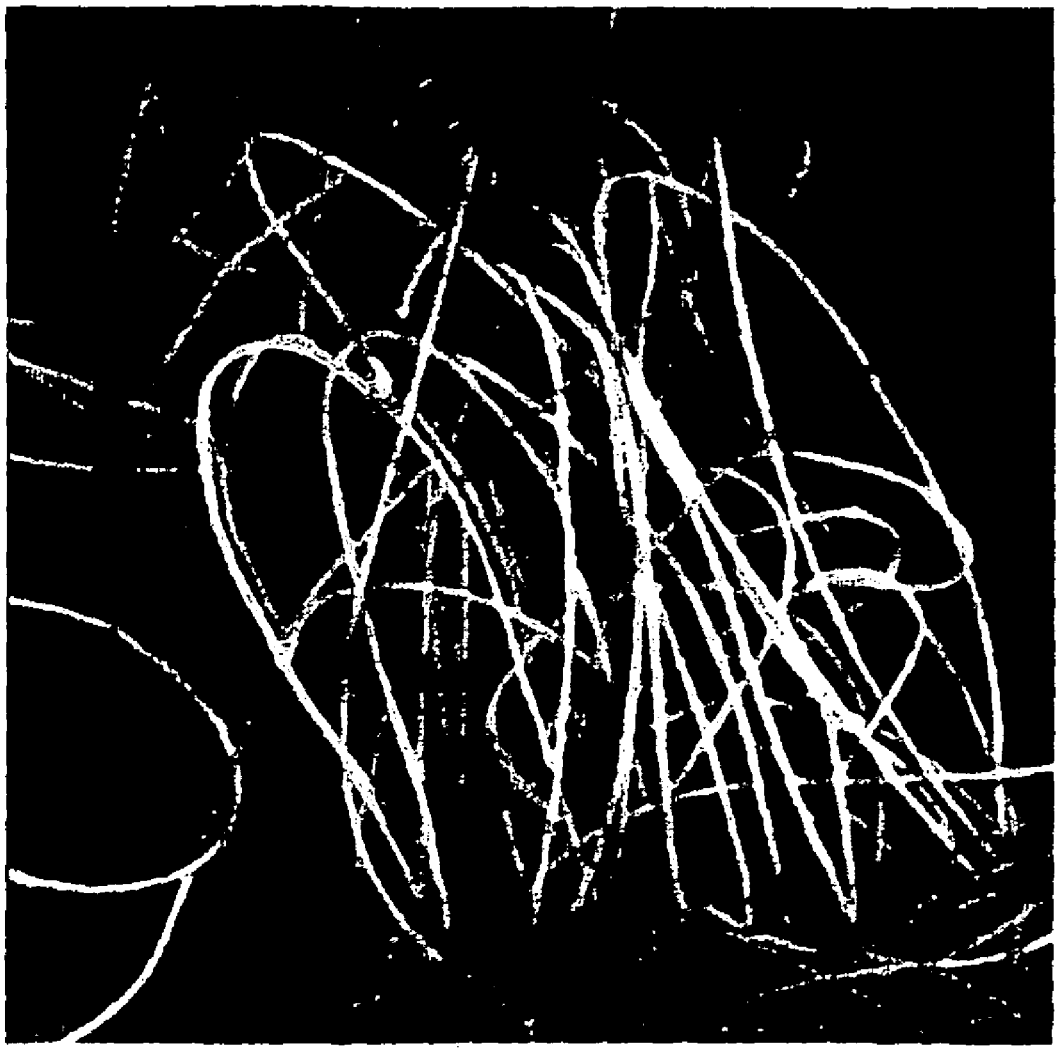
FIG. 11 is a photomicrograph of a portion of the looped web.
Figure 12:
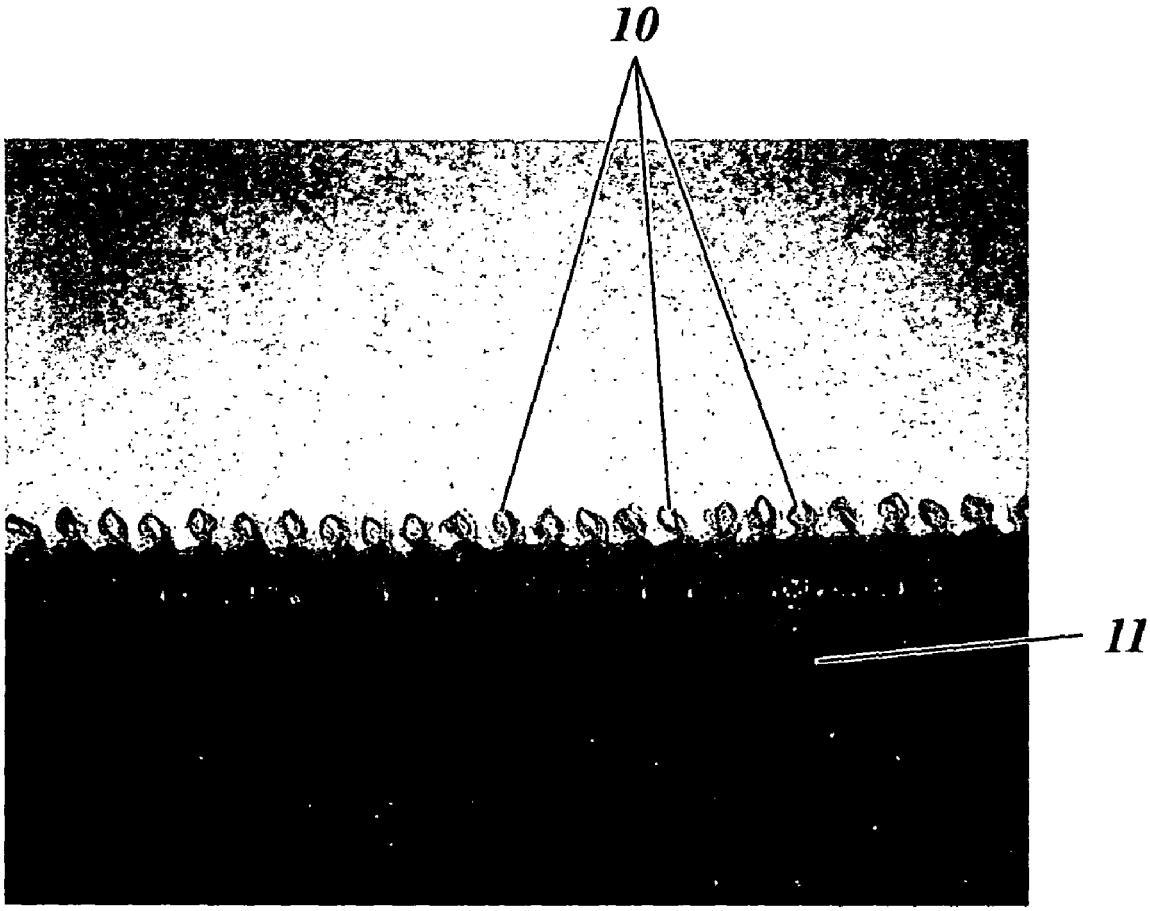
FIG. 12 is a photomicrograph of a portion of the looped web.

FIGS. 7, 8, and 9 show additional illustrations of the looped webs of the present invention. In FIG. 7, the loops 10 are seen to protrude from the web 11. The loops 10 illustrated in this illustration are shown to form an aligned tuft. A representative loop 10 from the embodiment of web 11 shown in FIG. 7 is shown in a further enlarged view in FIG. 8. As shown, a plurality of loops 10 are formed. The void area 19 is also shown. FIG. 10 illustrates the loop 10 with the first origination point 12 and second origination point 13 used to calculate the loop circumference length. The tip 14 of the loop 10 is also shown. FIGS. 10 and 11 are close-up SEM views of the loops 10 of the web 11. The void area 19 is more clearly seen in FIG. 10 which has more aligned loops 10 compared to FIG. 11. FIG. 12 is a photomicrograph of a terry cloth-like nonwoven web of the present invention. The loops 10 can be seen protruding from the web 11.

The starting or precursor nonwoven web will be processed to form the loops. The starting web can be of any nonwoven material that contains fibers. A nonwoven layer may be combined with a paper web, film web such as a preformed film, a textured film, an apertured film, and other polymeric films, woven fabric, knitted fabric, foam, foil, or any other layer to form a nonwoven web composite as long as one or more of the layers contains a fibrous nonwoven web. The nonwoven web may comprise more than one layers. The nonwoven web may be apertured prior to the formation of the loops, during the formation of the loops, or after formation of the loops. Additional layers may cover or provide a cap on top of the looped nonwoven web.

The starting fibrous nonwoven web can comprise unbonded fibers, entangled fibers, or tow fiber. It may also comprise continuous fibers which may be produced by spunbond methods or fibers cut to length which may be present in carded webs. The starting web may be produced by meltblowing or by airlaying or wet-laying nonwoven web. The webs may be thermally bonded, hydroentangled, spunlaid, chemically bonded, or entangled in another method. Although the webs may be thermally bonded, it may be desired that the web not be thermally bonded. The absence of any type of bonding or only very light bonding of the web may help enable the formation of the loops. The fibers or nonwoven webs can be colored or contain graphics or printing prior to being processed. Unless otherwise defined, the terms will have their conventional, ordinary meaning as used by those skilled in the art.

The fibers of nonwoven web can be comprised of polymers such as polyethylene, polypropylene, polyester, polyethylene, polyamides, polyvinyl acetates, and blends thereof. The term "polymer" generally includes, but is not limited to, homopolymers, copolymers, such as for example, block, graft, random and alternating copolymers, terpolymers, etc., and blends and modifications thereof. In addition, unless otherwise specifically limited, the term "polymer" includes all possible geometric configurations of the material. The configurations include, but are not limited to, isotactic, atactic, syndiotactic, and random symmetries. The fibers can comprise cellulose, rayon, cotton, or other natural materials or blends of polymers and natural materials. The fibers can also comprise a super absorbent material such as polyacrylate or any combination of suitable materials. The fibers can be absorbent or include fibrous absorbent gelling materials (like fibrous AGM). The fiber may be comprised of thermoplastic or non-thermoplastic materials. The-fiber maybe made from biodegradable polymeric materials such as, but not limited to, polyhydroxycarboxylic acids, polybutylenes, polylactic acids, thermoplasticized starch, starch composition, aliphatic polyesters, copolyesters, and other biodegradable polymers. Depending upon production of the fibers and web, the fibers of the web may comprise different compositions.

An extensible or elastic material may be used to the make the nonwoven webs which contain loops. However, it is not required, and sometimes not desired, that an elastic material is used to make the nonwoven web. In some applications, it may be desired to use an elastic material to make the nonwoven web so that the web can be processed in a way that the loops are scrunched together to make a tighter looped structure. This method of making loops may require two separate materials as one material is more elastic than the other material. The loops may be thinned or the fibers may have a smaller diameter at various locations along the loop. This may occur with extensible materials.

A variety of product applications containing a nonwoven web wherein at least one region of the nonwoven web comprises loops in at least about 10% of the surface area of the nonwoven web can be envisioned. Disposable hygiene articles such as diaper, training pants, adult incontinence product, catemenials, and tampons are a few of the potential uses. The nonwoven web can be utilized as one or more components in a hygiene article. For example, the nonwoven web with loops could be the topsheet (body-facing layer) on a diaper or catemenial product. The looped nonwoven web could be utilized in any use where a textured nonwoven web is desired. The nonwoven web could also be utilized as a wipe. Any suitable wipe utility could be envisioned including baby wipes, feminine care wipes, facial and body wipes, personal cleansing, hand wipes, household cleaning wipes, dusting wipes, fabric wipes, automotive or industrial use wipes. The wipes could have both sides containing the loops or only one side. Depending upon the use of the wipe, soft flexible webs could be desired or stiffer, stronger web may be utilized to aid in cleaning or particulate pick up.

The looped nonwoven web may be used for a wide variety of applications, including various filter sheets such as air filter, bag filter, liquid filter, vacuum filter, water drain filter, and bacterial shielding filter; sheets for various electric appliances such as capacitor separator paper, and floppy disk packaging material; various industrial sheets such as tacky adhesive tape base cloth, oil absorbing material, and paper felt; various dry or premoistened wipes such as hard surface cleaning, floor care, and other home care uses, various wiper sheets such as wipers for homes, services and medical treatment, printing roll wiper, wiper for cleaning copying machine, baby wipers, and wiper for optical systems; various medicinal and sanitary sheets, such as surgical gown, medical gowns, wound care, covering cloth, cap, mask, sheet, towel, gauze, base cloth for cataplasm, diaper, diaper liner, diaper cover, feminine napkin covers, feminine napkin or diaper acquisition layer (underneath the cover layer), diaper core, tampon liners, products for hair such as a hair wipe or hair wrap, base cloth for adhesive plaster, wet towel, paper towels, tissues; various sheets for clothes, such as padding cloth, pad, jumper liner, and disposable underwear; various life material sheets such as base cloth for artificial leather and synthetic leather, table top, wall paper, blind, wrapping, and packages for drying agents, shopping bag, suit cover, and pillow cover; various agricultural sheets, such as ground covers and erosion control devices, cooling and sun light-shielding cloth, lining curtain, sheet for overall covering, light-shielding sheet, wrapping materials of pesticides, underlining paper of pots for seeding growth; various protection sheets such as fume prevention mask and dust prevention mask, laboratory gown, and dust preventive clothes; various sheets for civil engineering building, such as house wrap, drain material, filtering medium, separation material, overlay, roofing, tuft and carpet base cloth, wall interior material, soundproof or vibration reducing sheet, and curing sheet; and various automobile interior sheets, such as floor mat and trunk mat, molded ceiling material, head rest, and lining cloth, in addition to a separator sheet in alkaline batteries. Other uses of the looped nonwoven substrate include towels, hand towels, wash clothes, robes, clothing, and all other uses where terry cloth and terry-cloth like fabrics are used. These products can be used as a disposable or semi-durable meaning that they can be used more than one time. The looped nonwoven web can also be used as a landing zone or area for a product to adhere to something else. The looped structure aids in this function is may be able to catch or hook to a desired material.

Products containing the looped webs of the present invention may appear to the naked eye to be comprised of a terry cloth woven material. The nonwoven webs may increase the perception that the product is soft and fluffy. The looped nonwoven webs may increase the loft or height of the nonwoven web, decrease the web density, increase the softness, increase the surface area of the nonwoven web, increase the texture, increase fluid handling properties such as penetration, absorption, or retention, and various other benefits. The loops may provide extra stand up or strength to keep the nonwoven web with a higher loft. Because of the narrow base of the loop, this loft or texture may be more permanent that other texturing processes. The base of the loop is narrow and may lock or hold the loop in place that it will not allow the fibers or nonwoven web to slide back down into the original shape. The permanent texture may also aid in fluid handling while a product is under pressure during use such as a baby sitting on the diaper. If the loops are aligned to form a tuft, the resulting nonwoven web may further aid in fluid handling as a tunnel-like structure is formed which allows for lateral entry of fluids.

The looped nonwoven webs of the present invention can be made by various methods. The means for making looped nonwoven webs are any method that is able to form multiple loops from a starting nonwoven web. The means for producing the loops is not a textile process but a process for producing the looped nonwoven web or engineered fabric. The processes are utilized to move the fibers into positions to form loops and not necessarily move the fabric or entire nonwoven. The method chosen will depend upon the ultimate use of the web, materials desired, size of the loops, and many other characteristics. It may be desired to combine more than one of the processes or utilize a variety of steps.

A method for producing a nonwoven web comprising a plurality of loops comprises the steps of providing a nonwoven web; providing means for moving fibers of the nonwoven web into the shape of a loop; and moving fibers of the nonwoven web into the shape of a loop. Methods of producing the loops include, but are not limited to, needle punching, creping, hydroentangling, deposition on a forming belt, processing with intermeshing rolls, and combinations thereof. Shape memory materials or elastic materials may also be used independently or in one of the processes.

Needle punching is generally used to mechanically entangle the fibers of one or more fabrics. It can also be used to push fibers of a fabric or nonwoven substrate into another to integrate two or more layers. Needle punching could be modified to be used to form loops from the nonwoven web. The needles may need to be flattened or blunted so that they would push selected fibers through the plane of the web and into the Z direction to form a loop. The general needle punching process would need to be controlled to minimize the overlap in processing the web. The spacing of the needles would also need to be optimized depending upon the size of the fibers and size of loops formed. The needle punching equipment and method could be modified to push fibers of a nonwoven web through a pre-apertured web or scrim to aid in the formation of a loop with a narrow base. A similar process and equipment to needle punching could also be developed with pins or teeth or other shaped metal structures replacing the needles.

Another method of forming a looped structure could be through the use of a creping or corrugation methods. Creping, including micro-creping such as by the Micrex process, or corrugation could be used to create a loop or tunnel like structure. It may be desired to use an elastic, shrinkable, or prestretched material in the process to aid in the creation of a narrow based loop or tuft. The process could be combined with a slitting process, either before or after forming the loop, which would enable the loop or tunnel structure to allow for lateral fluid entry which can be beneficial in absorbent articles.

Specialty materials with shape memory or other characteristics may be utilized to form loops. The material could be formed into loops when exposed to a temperature change or when contacted with water. The specialty materials could also be layered on a scrim, apertured web, formed belt, or strips of material to provide the mechanism for the material to form into tufts.

Another potential method of forming loops includes the use of forming belts. The forming belts may contain a three dimensional pattern to enable the formation of loops. A resin coated paper making belt may be used. The forming belt may have "loop shaped" forms that the fibers are deposited into. Alternatively, the forming belt could have apertures that enable the fibers to extend through the plane of the forming belt thus creating a loop. The fibers could be spunbond or meltblown and then deposited onto the forming belts. A wet-laying or air-laying method could also be used to form the fibers and nonwoven substrate on a forming belt. The shape of the forming belt and the particular materials used will be important in forming a looped shape versus forming a textured nonwoven that is not narrower at the base. The forming belt may be coated with latex, a lotion, a surface energy modifier, starch, adhesives, or lubricants to aid in the release or formation of the loops. A scrim or apertured substrate may also be utilized on the forming belt by having the fibers landing on the scrim and then penetrating thought the scrim to form a looped shaped. The forming belt may or may not be required to be patterned in this method. A vacuum or other air pressure means could be utilized to aid in the formation of loops on a forming belt. If the vacuum is placed below the belt and pulls the fibers through the plane, a loop shape may be more easily formed.

Hydroentangling processes may also be utilized to form a looped nonwoven web. The hydroentangling may be utilized by itself or in combination with another process. Many patterned hydroentangling approaches, such as Nub-tex from BBA and Miratec from PGI, utilize patterned screens. The screen can be designed so that the fibers of the nonwoven web are forced out of the plane and into the shape of the loop. The specific screen design will depend upon the shape of the loop desired. A screen with apertures, strips of material, or other patterns may be utilized. The spray of the water jets may need to be controlled and adjusted to aid in the guiding of the fibers into the shape of loops. Additionally, a scrim or apertured web could be utilized to aid in the formation of loops as the water jets would aid in the pushing of the fibers through the scrim to form a looped shaped with a narrow base.

Figure 13:
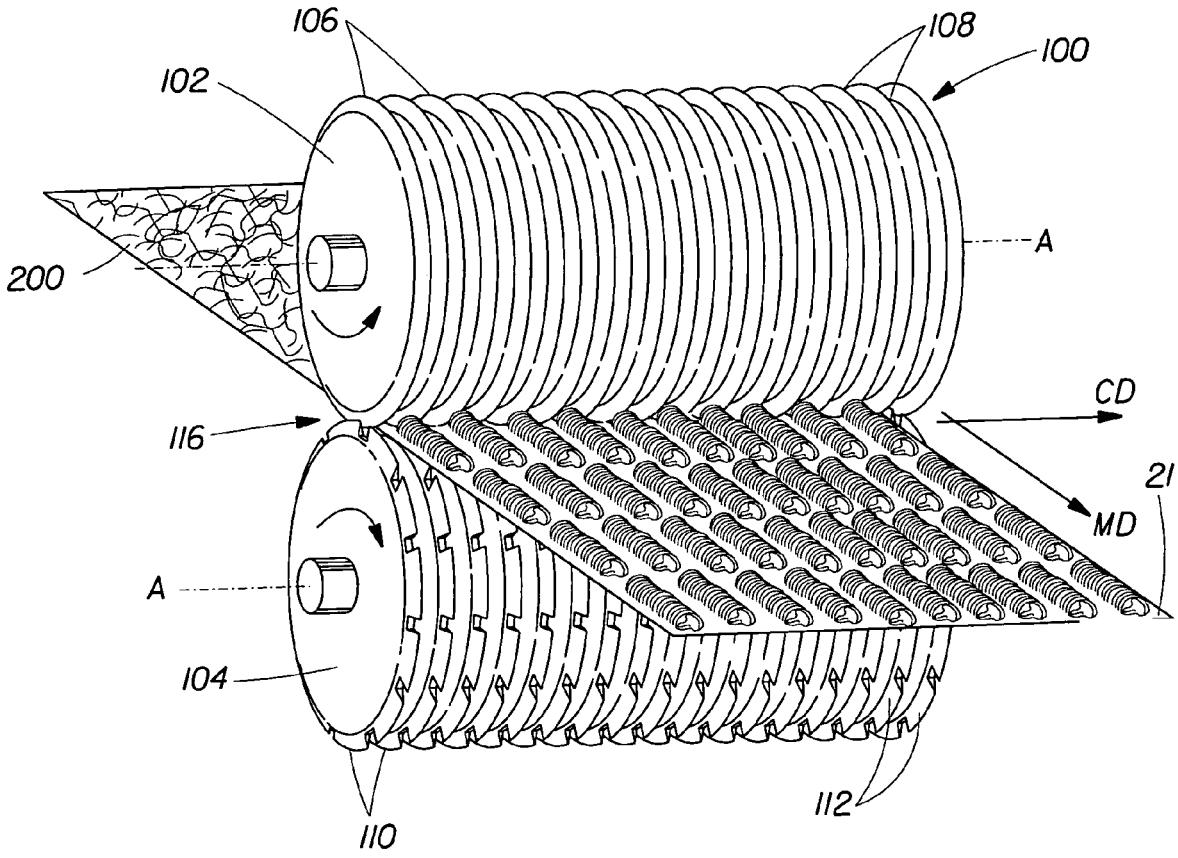
FIG. 13 is a perspective view of an apparatus that can be used to form the looped web.

Another method of forming the looped nonwoven web is by using intermeshing rolls. Referring to FIG. 13 there is shown in an apparatus and method for making loops 10 of the present invention. The apparatus 100 comprises a pair of intermeshing rolls 102 and 104, each rotating about an axis A, the axes A being parallel in the same plane. Roll 102 comprises a plurality of ridges 106 and corresponding grooves 108 which extend unbroken about the entire circumference of roll 102. Roll 104 is similar to roll 102, but rather than having ridges that extend unbroken about the entire circumference, roll 104 comprises a plurality of rows of circumferentially-extending ridges that have been modified to be rows of circumferentially-spaced teeth 110 that extend in spaced relationship about at least a portion of roll 104. The individual rows of teeth 110 of roll 104 are separated by corresponding grooves 112. In operation, rolls 102 and 104 intermesh such that the ridges 106 of roll 102 extend into the grooves 112 of roll 104 and the teeth 110 of roll 104 extend into the grooves 108 of roll 102. The teeth 110 can be in rows or can be staggered or spaced to create a variety of different patterns and loops.

In FIG. 13, the apparatus 100 is shown in a preferred configuration having one patterned roll, e.g., roll 104, and one non-patterned grooved roll 102. However, in certain embodiments it may be preferable to use two patterned rolls 104 having either the same or differing patterns, in the same or different corresponding regions of the respective rolls. Such an apparatus can produce webs with loops protruding from both sides of the web. The intermeshing rolls may be utilized to produce webs at fast line speeds such as greater than about 1500 feet per minute.

The process described using intermeshing rolls is similar in many respects to a process as described in U.S. Pat. No. 5,518,801, incorporated herein by reference, entitled "Web Materials Exhibiting Elastic-Like Behavior" and referred to in subsequent patent literature as "SELF" webs, which stands for "Structural Elastic-like Film". However, there are differences between the apparatus of the present invention and the apparatus disclosed in the above-identified '801 patent. These differences account for the novel narrow base loops in the web of the present invention. As described below, the teeth 110 of roll 104 have a specific geometry associated with the leading and trailing edges that permit the teeth, e.g., teeth 110, to essentially "punch" through the starting web 200 as opposed to, in essence, emboss the web. The difference in the apparatus 100 of the present invention results in a fundamentally different web. For example, a web of the present invention will have loops unlike the "tent-like" rib-like elements of prior art SELF webs which have wide bases and do not meet the definitions of a loop.

The method of producing a looped nonwoven web by utilizing intermeshing rolls could be done with an elastic material. The elastic material could be prestretched. Alternatively, the starting web could include a scrim or apertured nonwoven web to aid in the formation of loops with utilizing intermeshing rolls. Other modifications or variations of the rolls may also be used.

The process may utilize an elastic material or web that is prestretched so that a higher density of loops results or to enable the formation of the loops by the material pulling together and forcing the fibers out of the plane to form a loop. Although elastic materials can be utilized to aid in the formation of loops, elastic materials are not required and in many cases are not preferred. Therefore, the loops of the present invention can be formed without the use of an elastic material.

A web or scrim with apertures could be utilized to help form the loops. A prestretched web, apertured web, or scrim could be used. When the prestretched web or scrim is released, loops with narrow bases can be formed. Loops may also be made by utilizing a prestretched web material that penetrates through a scrim or apertured web. When the prestretched material is released, it may pull the apertured web or scrim together to help form a looped shape. In other methods, neither the web material nor the apertured web or scrim need to be prestretched. The apertured web material could be an apertured nonwoven web made according to U.S. Pat. Nos. 4,528,097 and 5,916,661.

After formation of the looped nonwoven web, the web can go through additional processing. This could be to apply a lotion, adhesive, or coating or to print on the nonwoven web. The loops could also be cut through a variety of processes such as a wire bush wheel or knives or a blade, slitting, or blowing with high pressure air or water. Therefore, the looped nonwoven web could be an intermediate structure.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An article selected from the group consisting of disposable hygiene articles and wipes, said article comprising a generally planar nonwoven web having a machine direction and a cross direction wherein at least one region of the nonwoven web comprises generally aligned loops in at least about 10% of the surface area of the nonwoven web, said loops comprising one or more fibers, wherein said loops extend from within and out of said generally planar nonwoven web, wherein said fibers of said loops are generally aligned with one another in said machine direction and said cross direction to form a tunnel shaped tuft, wherein said loops comprise an origination point and a tip distal from said origination point, and wherein said nonwoven web comprises a layer positioned to cover or cap said tip of said loops.

2. The article according to claim 1 wherein said layer is selected from the group consisting of a preformed film, a textured film, an apertured film, a nonwoven, and combinations thereof.

3. The article according to claim 1 wherein the loop has a loop circumference length to loop base length ratio that is greater than about 4:1.

4. The article according to claim 1 wherein the loop has a loop base length less than 0.5 cm.

5. The article according to claim 1 wherein the loop has a base length less than a maximum width of the loop.

6. The article according to claim 1 wherein loop has a loop height to loop base length ratio that is greater than about 2:1.

7. The article according to claim 1 wherein there are at least about 10 loops per square centimeter.

8. The article according to claim 1 wherein said nonwoven web further comprises apertures.

9. A web comprising:

a. a first nonwoven layer comprising a generally planar surface and at least one region containing a plurality of loops extending from and above said generally planar surface, said loops comprising one or more fibers, wherein said fibers of said loops are generally aligned with one another to form a tunnel shaped tuft; and b. a second layer positioned on top of said first nonwoven layer so that the second layer provides a cover or cap on tips of said loops.

10. The web according to claim 9 wherein said second layer is selected from the group consisting of a preformed film, a textured film, an apertured film, a nonwoven, and combinations thereof.

* * * * *